US006637314B2

(12) United States Patent
Nagai et al.

(10) Patent No.: US 6,637,314 B2
(45) Date of Patent: Oct. 28, 2003

(54) ACTUATOR

(75) Inventors: Shigekazu Nagai, Adachi-ku (JP); Akio Saitoh, Kawaguchi (JP); Masaki Miyahara, Kitasoma-gun (JP)

(73) Assignee: SMC Kabushiki Kaisha, Tokyo (JP)

( * ) Notice: Subject to any disclaimer, the term of this patent is extended or adjusted under 35 U.S.C. 154(b) by 92 days.

(21) Appl. No.: 10/058,429

(22) Filed: Jan. 30, 2002

(65) Prior Publication Data

US 2002/0100362 A1 Aug. 1, 2002

(30) Foreign Application Priority Data

Jan. 30, 2001 (JP) ..... 2001-022344

(51) Int. Cl.[7] ..... F01B 9/00
(52) U.S. Cl. ..... 92/136; 92/36; 60/716
(58) Field of Search ..... 92/136, 36; 60/716, 60/720

(56) References Cited

U.S. PATENT DOCUMENTS 2,218,719 A * 10/1940 Richards ..... 92/136
2,660,026 A * 11/1953 Geyer ..... 60/720
6,116,139 A * 9/2000 Yuda et al. ..... 92/136

* cited by examiner

*Primary Examiner*—Edward K. Look
*Assistant Examiner*—Michael Leslie
(74) *Attorney, Agent, or Firm*—Paul A. Guss

(57) ABSTRACT

An air is evacuated from a chamber of a bellows by a vacuum pressure supply source connected to a vacuum port of an attachment plate. The vacuum pressure in a vacuum chamber is thus balanced with the vacuum pressure in the chamber of the bellows. Consequently, the bellows is prevented from expanding by balancing the respective vacuum pressures in the chamber of the bellows and in the vacuum chamber.

9 Claims, 13 Drawing Sheets

ACTUATOR

BACKGROUND OF THE INVENTION

1. Field of the Invention

The present invention relates to an actuator having a slider capable of being reciprocated by a driving action of a driving section.

2. Description of the Related Art

An actuator disposed in a vacuum chamber has been conventionally used for a semiconductor-producing apparatus. The actuator has a slider connected to an external main actuator body through a rod so that the slider can linearly and vertically move in the vacuum chamber. The rod penetrates through a hole defined in a wall of the vacuum chamber. If the hole for the rod to be penetrated therethrough is not sufficiently sealed, the vacuum pressure in the vacuum chamber becomes unstable.

According to the conventional actuator, a seal means such as a bellows is disposed around the outer circumference of the rod. The through-hole for the rod is shielded by the seal means so that the rod can stabilize the vacuum pressure.

According to the conventional actuator, however, when the slider is reciprocated by the driving action of the actuator, the vacuum chamber is under vacuum pressure. By contrast, the bellows for shielding the through-hole for the rod is under atmospheric pressure. Therefore, the expanding force is applied to the bellows based upon pressure difference in and out of the bellows. The durability of the bellows is consequently deteriorated.

Accordingly, a cycle of maintenance such as exchanging the bellows becomes short and efficiency of producing the semiconductor is lowered.

SUMMARY OF THE INVENTION

It is a general object of the present invention to provide an actuator which balances the vacuum pressure in a chamber of the bellows and the vacuum pressure in a vacuum chamber and which prevents the bellows from expanding, thereby enabling the durability of the bellows to be improved.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
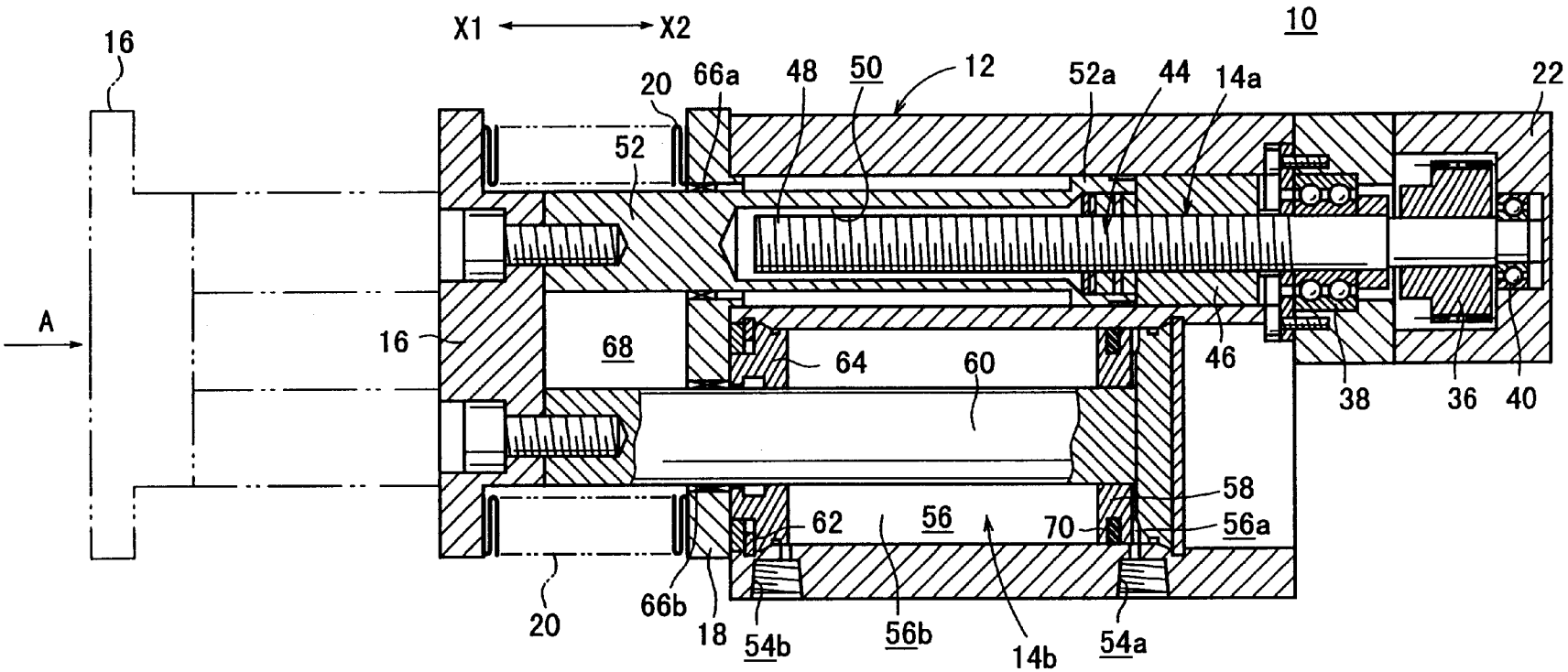
FIG. 1 is an axially longitudinal sectional view illustrating an actuator according to a first embodiment of the present invention.

In FIG. 1, reference numeral 10 indicates an actuator according to a first embodiment of the present invention.

Figure 3:
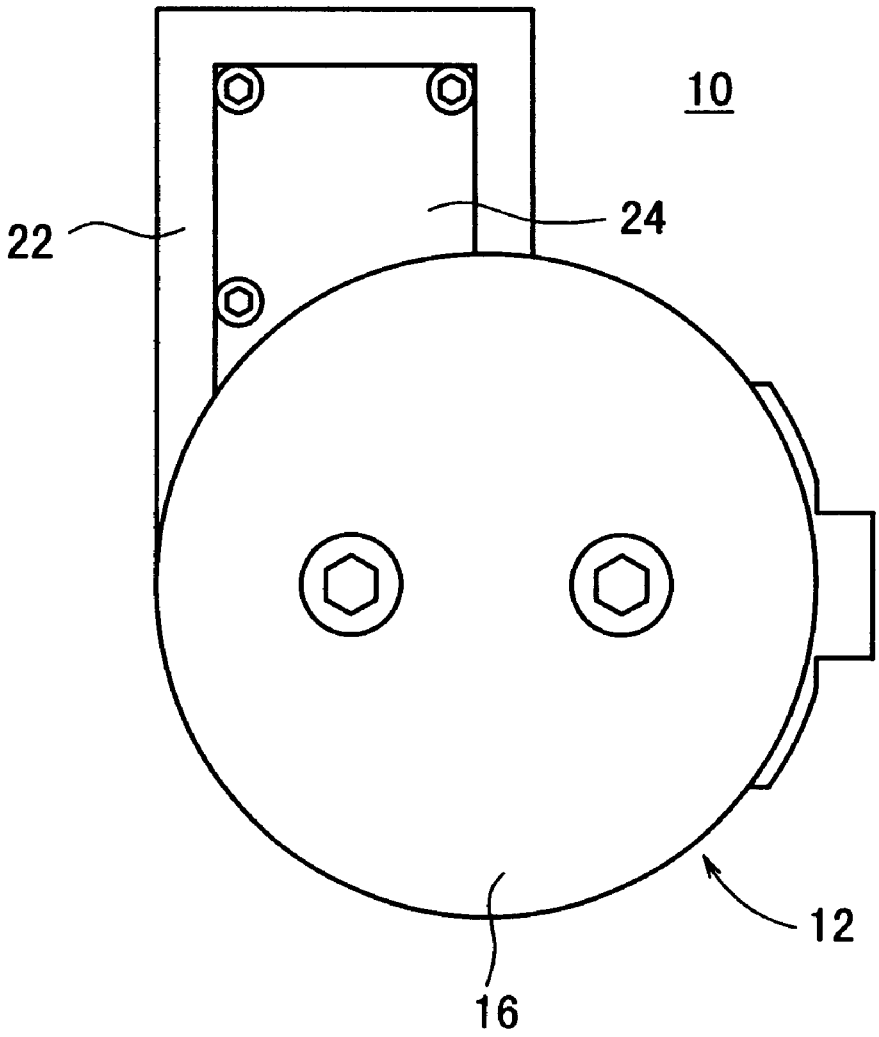
FIG. 3 is a side view as viewed in the direction of the arrow A shown in FIG. 1.

The actuator 10 comprises an actuator body 12, a first driving section 14*a*, a second driving section 14*b*, and a substantially disk-shaped slider 16 (see FIG. 3). The actuator body 12 deviates widthwise toward one end of the actuator body 12 substantially perpendicular to the axis. The actuator body 12 functions as a main driving source. The second driving section 14*b* is juxtaposed with the first driving section 14*a* and deviates widthwise toward the other end of the actuator body 12. The second driving section 14*b* functions as an auxiliary driving source. The substantially disk-shaped slider 16 is displaceable in the axial direction of the actuator body 12 under the driving action of the first driving section 14*a* and/or the second driving section 14*b*.

The second driving section 14*b* is arbitrarily driven in order to assist the first driving section 14*a* corresponding to the load applied to the slider 16 such as the bulk of an unillustrated workpiece.

The actuator 10 further comprises an attachment plate 18 and a bellows 20 which is made of metal. The attachment plate 18 is connected to one axial end of the actuator body 12. The bellows 20 is disposed between the attachment plate 18 and the slider 16. The bellows 20 has one end installed to the attachment plate 18 and the other end installed to the slider 16.

Figure 2:
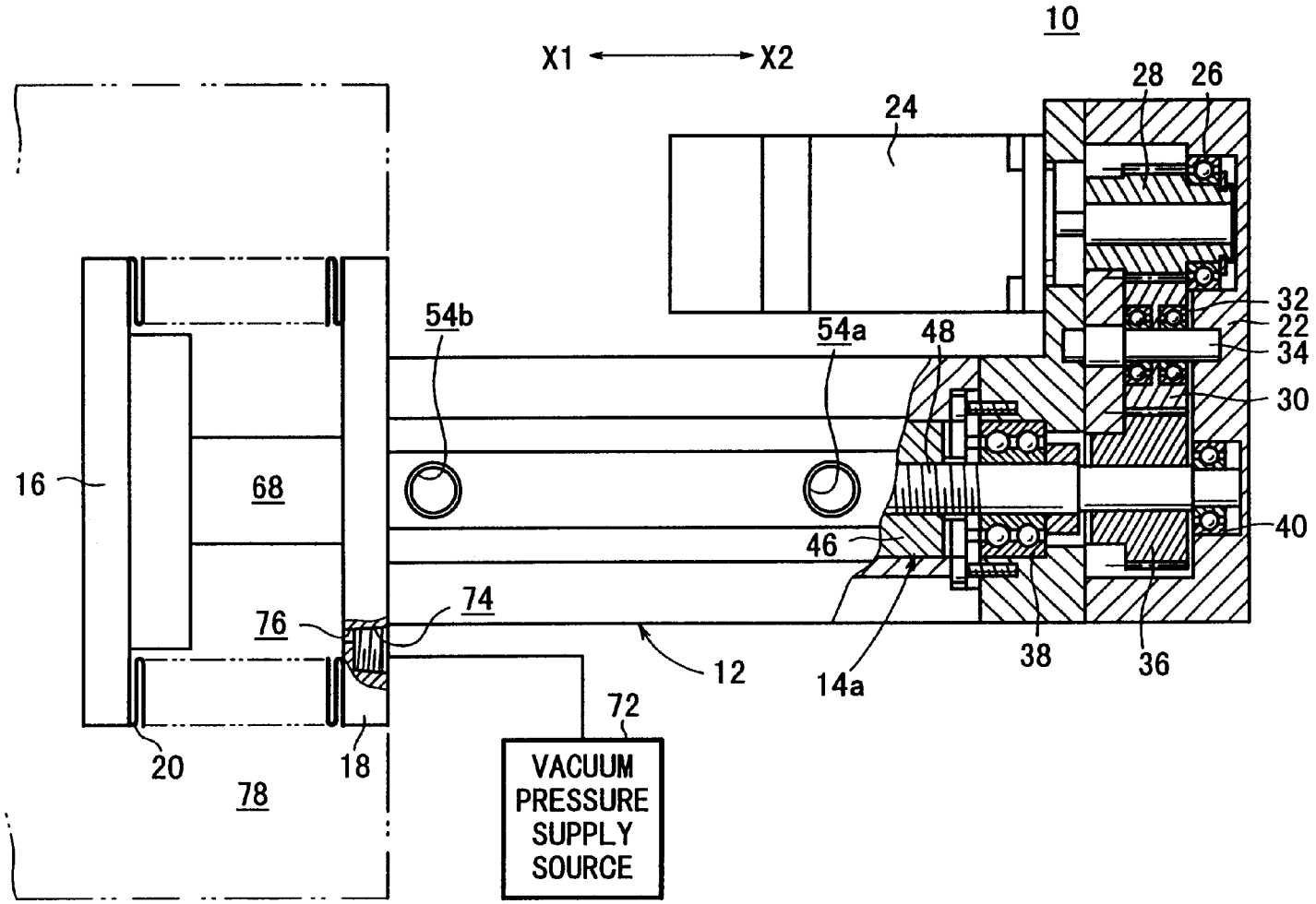
FIG. 2 is, with partial cutout, a plan view illustrating the actuator shown in FIG. 1.

As shown in FIG. 2, the first driving section 14*a* includes a rotary driving source 24, a first gear 28, a second gear 30, a pin 34, a third gear 36 and third and fourth bearings 38, 40. The rotary driving source 24 is connected to a side of the actuator body 12 by a casing 22. The first gear 28 is rotatably supported in the casing 22 by a first bearing 26 and is connected coaxially with a drive shaft of the rotary driving source 24. The second gear 30 is meshed with the first gear 28. The pin 34 rotatably supports the second gear 30 with a second bearing 32. The third gear 36 is meshed with the second gear 30. The third and fourth bearings 38, 40 rotatably support a feed screw shaft (as described later on) connected to the third gear 36.

As shown in FIG. 1, the first driving section 14*a* has a rotary driving force-transmitting mechanism 44 which converts the rotary driving force of the rotary driving source 24 into the rectilinear motion to be transmitted to the slider 16. The rotary driving force-transmitting mechanism 44 includes a substantially cylindrical nut 46, a feed screw shaft (driving rod) 48 and a rod 52. The substantially cylindrical nut 46 has an unillustrated threaded portion formed on the inner wall surface of a through-hole. A threaded portion formed on the outer circumferential surface of the feed screw shaft 48 is screwed into a threaded portion of the nut 46. The rod 52 is connected to the nut 46 and is displaceable integrally with the nut 46. A hollow section 50 is defined in the rod 52. One end of the feed screw shaft 48 faces the hollow section 50. One end of the rod 52 protrudes from the attachment plate 18 and is connected to the slider 16.

The feed screw shaft 48 may be either a ball screw shaft or a slide screw shaft. An annular projection 52*a* is formed at the other end of the rod 52 and serves as a stopper by making abutment against the attachment plate 18.

The second driving section 14*b* comprises a piston 58, a piston rod 60 and a rod cover 64. The piston 58 is composed of a cylinder and is displaceable along a cylinder chamber 58 by the pressure fluid supplied from one of a pair of pressure fluid inlet/outlet ports 54*a*, 54*b* formed through the actuator body 12. The piston rod 60 is connected to the piston 58 and has one end protruding from the attachment plate 18 and connected to the slider 16. The rod cover 64 is fastened to the actuator body 12 by a retaining ring 62 and keeps the cylinder chamber 56 airtight.

The piston rod 60 is substantially parallel to the rod 52. Bushes 66*a*, 66*b* are disposed in the hole of the attachment plate 18 and supports the rectilinear motion of the piston rod 60 and the rod 52. The bushes 66*a*, 66*b* also function as seal means for preventing air from leaking when the pressure in a chamber 68 surrounded by the bellows 20 is reduced.

A piston packing 70 is installed to the outer circumferential surface of the piston 58. One cylinder chamber 56*a* and the other cylinder chamber 56*b* which are divided by the piston 58 are kept airtight by the piston packing 70.

The bellows 20 made of metal is connected between the attachment plate 18 and the slider 16. The bellows 20 surrounds both of the rod 52 and the piston rod 60 which are connected to the slider 16. The airtight chamber 68 is defined in the bellows 20. As shown in FIG. 2, the attachment plate 18 has a vacuum port 74 connected to a vacuum pressure supply source 72 through a tube passage such as a tube. The vacuum port 74 communicates with the chamber 68 through a passage 76.

The actuator 10 according to the first embodiment of the present invention is basically thus constructed. Its operation, function, and effect will be explained below.

The attachment plate 18 is attached to the vacuum chamber 78 by an unillustrated flange (see FIG. 2). An unillustrated power source is turned on to energize the rotary driving source 24. The rotary driving force of the rotary driving source 24 is transmitted to the feed screw shaft 48 through the first to third gears 28, 30, 36 which are meshed with each other. The force is also transmitted to the nut 46 which is screwed by the unillustrated threaded portion over the feed screw shaft 48. The rotary driving force of the rotary driving source 24 is converted into the rectilinear motion by the screwing action effected between the feed screw shaft 48 and the nut 46. The rod member 52 and the slider 16 are displaced integrally toward the axis (direction of the arrow X1) of the actuator body 12.

To assist the first driving section 14*a* as the main driving source, the second driving section 14*b* serving as the auxiliary driving source may be driven substantially simultaneously with the first driving section 14*a*. In the second driving section 14*b*, the pressure fluid (for example, air) is supplied from the unillustrated pressure fluid supply source to the cylinder chamber 56*a* through the one pressure fluid inlet/outlet port 54*a* (54*b*). The piston 58 and the piston rod 60 are displaced integrally in the direction of the arrow X1 by the pressure fluid introduced into the cylinder chamber 56*a*.

If polarity of the current supplied to the rotary driving source 24 is switched with the slider 16 reaching the displacement terminal end position, the rotating direction of the feed screw shaft 48 is also reversed. The rod 52, the piston rod 60 and the slider 16 are displaced opposite to the direction of the arrow X1 (in the direction of the arrow X2) back to the original position.

When the rod 52, the piston rod 60 and the slider 16 which are juxtaposed to one another are integrally displaced, the bellows 20 fastened to the slider 16 is elongated or contracted, thereby changing the volume of the chamber 68 surrounded by the bellows 20, the slider 16 and the attachment plate 18. Then, the vacuum pressure supply source 72 is energized to evacuate an air from the chamber 68 through the vacuum port 74.

Therefore, the pressure in the chamber 68 is reduced by evacuating the air from the chamber 68 surrounded by the bellows 20, the slider 16, and the attachment plate 18. The evacuation is performed until the balance is made with the vacuum pressure in the vacuum chamber 78 in which the slider 16 is arranged.

In the first embodiment, the vacuum pressure in the vacuum chamber 78 in which the slider 16 is displaced is balanced with the vacuum pressure in the chamber 68 closed by the bellows 20, the slider 16 and the attachment plate 18. The bellows 20 can be prevented from expanding to improve the durability thereof. A cycle of the maintenance such as exchanging the bellows 20 can be consequently longer. It is thus possible to increase efficiency for producing semiconductors produced by an unillustrated semiconductor-producing apparatus equipped with the actuator 10.

An actuator 100 according to a second embodiment of the present invention is shown in FIGS. 4 to 7. The same components as those of the actuator 10 according to the first embodiment are designated by the same reference numerals. Detailed explanation thereof will be omitted.

The second embodiment is different from the first embodiment in that only a feed screw shaft 102 is disposed in a chamber 68 of a bellows 20, and a slider 16 is displaced integrally by only the feed screw shaft 102.

Figure 4:
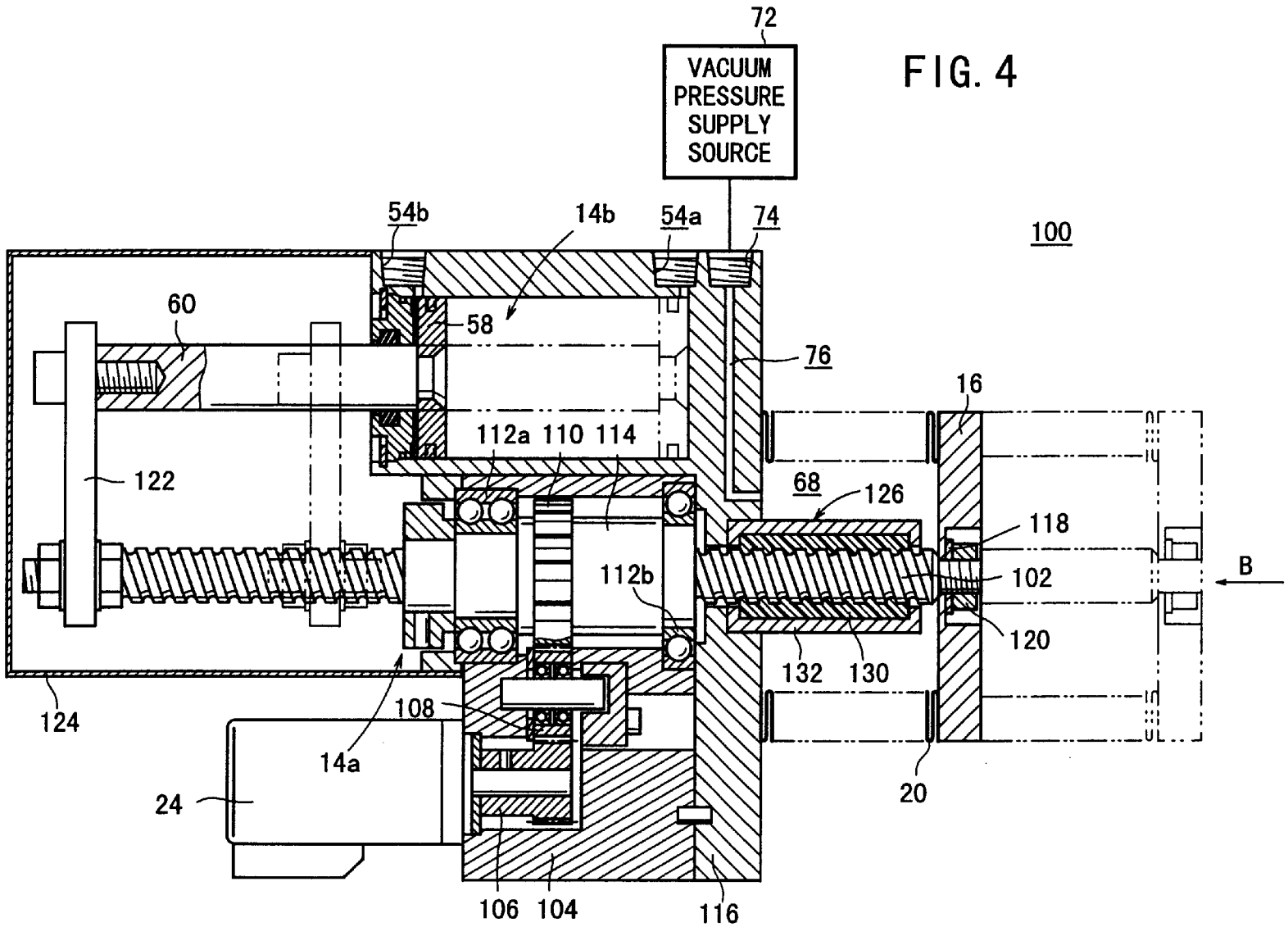
FIG. 4 is an axially longitudinal sectional view illustrating an actuator according to a second embodiment of the present invention.

As shown in FIG. 4, the actuator 100 according to the second embodiment comprises a first gear 106, a second gear 108, a cylindrical nut 114 and the feed screw shaft 102. The first gear 106 is connected coaxially to a drive shaft of a rotary driving source 24 and is rotatably supported in a housing 104. The second gear 108 is meshed with the first gear 106. The cylindrical nut 114 has teeth 110 formed at a substantially central portion to be meshed with teeth of the second gear 108 and is rotatably supported by first and second bearings 112*a*, 112*b* arranged at both ends. The feed screw shaft 102 penetrates through the nut 114 and is screwed into an unillustrated threaded portion of the nut 114.

Figure 5:
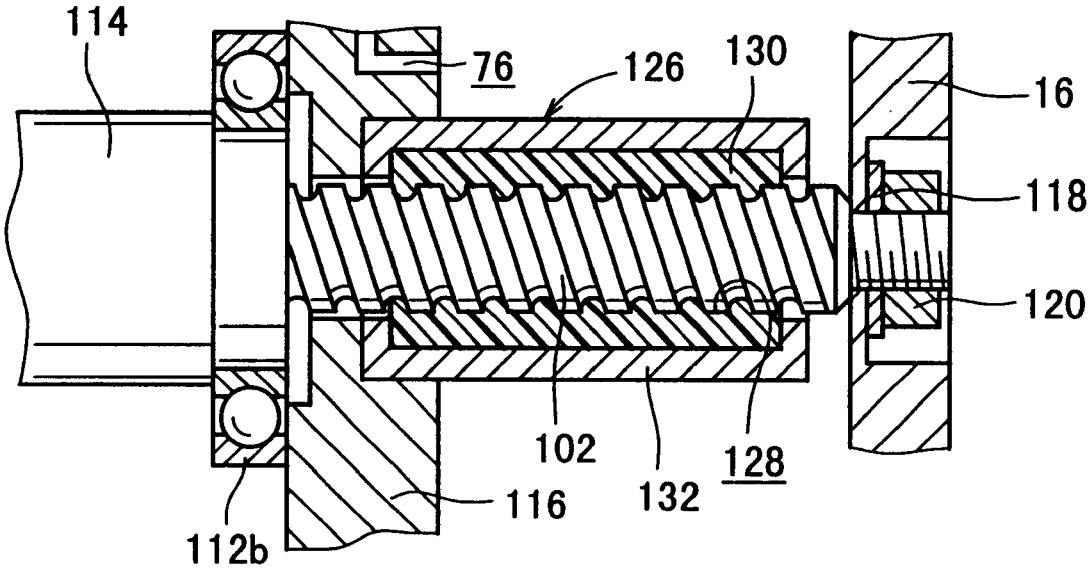
FIG. 5 is a partial magnified longitudinal sectional view illustrating the actuator shown in FIG. 4.
Figure 6:
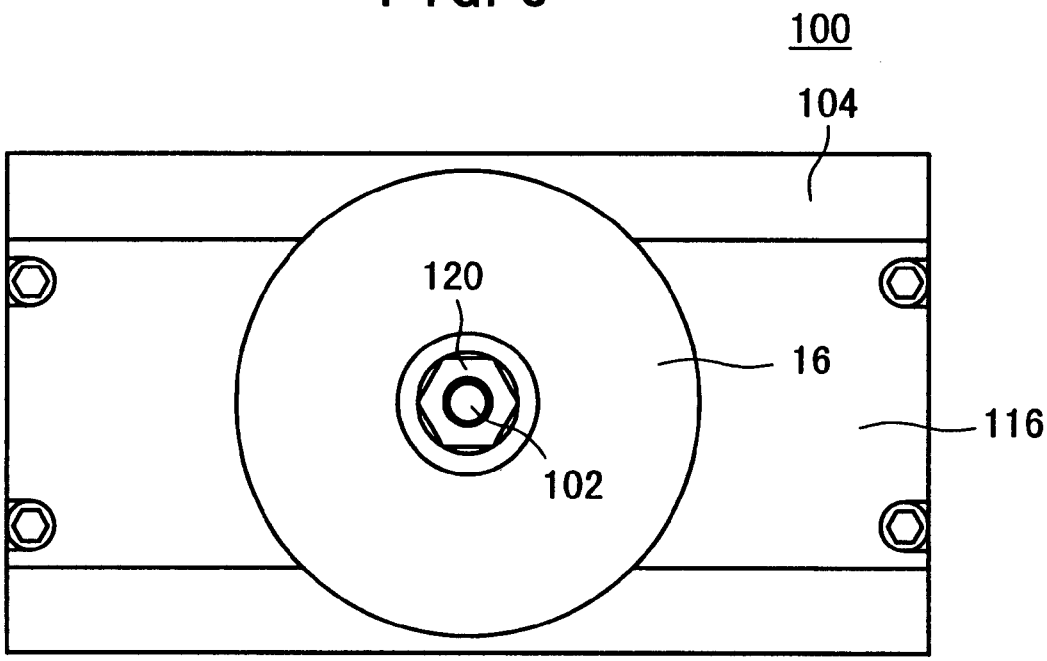
FIG. 6 is a side view as viewed in the direction of the arrow B shown in FIG. 4.
Figure 7:
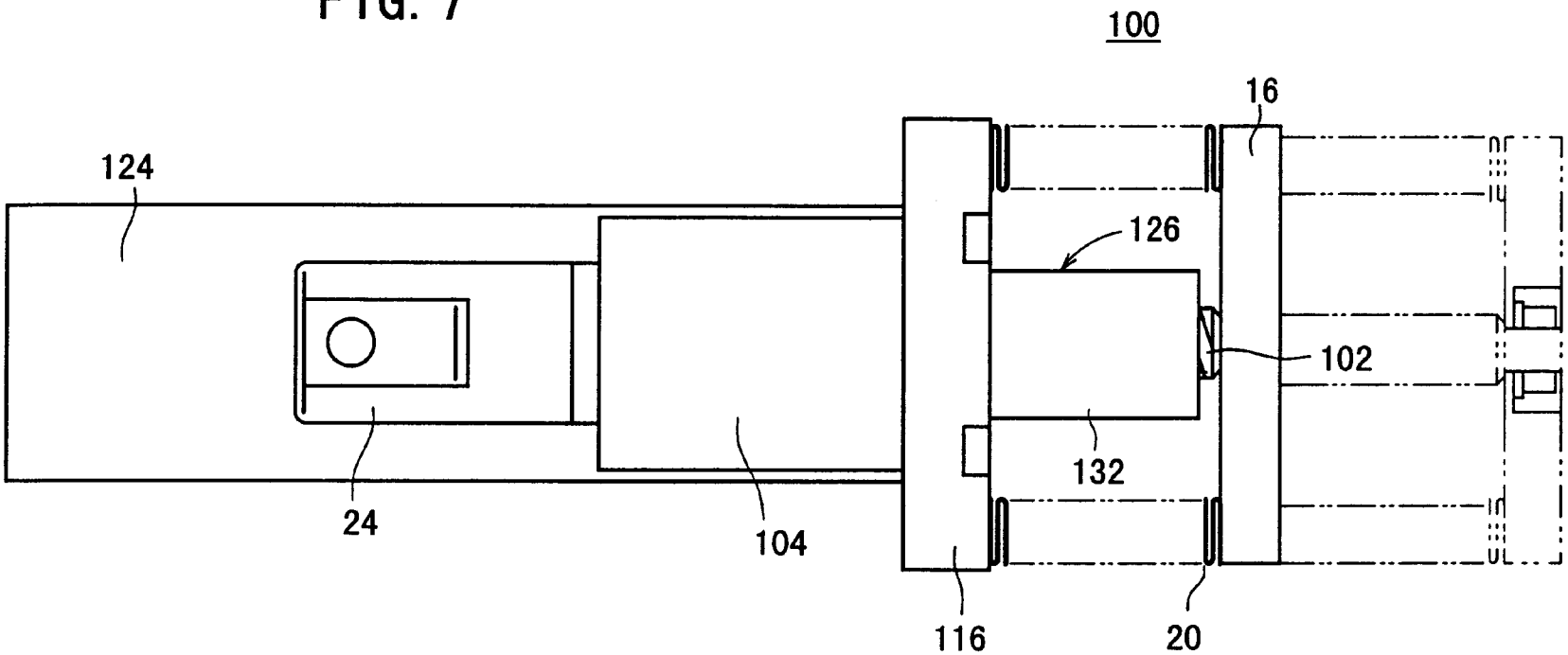
FIG. 7 is, with partial cutout, a plan view illustrating the actuator shown in FIG. 4.

A slider 16 is connected via a washer 118 and a lock nut 120 to one end of the feed screw shaft 102 protruding from an attachment plate 116 (see FIG. 5). The bellows 20 made of metal is installed between the slider 16 and the attachment plate 116. As shown in FIG. 4, a connecting plate 122 is disposed at the other end of the feed screw shaft 102 and is connected to a piston rod 60 of a second driving section 14*b*. The connecting plate 122 is accommodated in a cover member 124.

As shown in FIG. 5, a seal mechanism 126 is disposed in the chamber 68 of the bellows 20. The seal mechanism 126 keeps a chamber 68 airtight by sealing the gap between the attachment plate 116 and the feed screw shaft 102.

The seal mechanism 126 comprises a cylindrical seal 130 made of resin and a tube 132 made of metal. The cylindrical seal 130 has a screw groove 128 screwed over the threaded portion of the feed screw shaft 102 and is rotatable by the reciprocating movement of the feed screw shaft 102. The tube 132 rotatably covers the seal 130 via an unillustrated clearance formed between the seal 130 and the tube 132 and is secured to the attachment plate 116.

The rotary driving force is transmitted to the nut 114 having the teeth 110 by the first gear 106 and the second gear 108 under the rotary driving action of the rotary driving source 24. Further, the rotary driving force is transmitted to the feed screw shaft 102 which is screwed into the unillustrated screw groove of the nut 114. The rotary driving force of the rotary driving source 24 is converted into the rectilinear motion under the screwing action between the nut 114 and the feed screw shaft 102. Thus, the feed screw shaft 102 is axially displaced.

The rectilinear motion of the reciprocating feed screw shaft 102 is converted into the rotary motion under the screwing action between the feed screw shaft 102 and the seal 130. The seal 130 is thus rotated. The seal 130 seals the space between the feed screw shaft 102 and the seal 130 and the space between the seal 130 and the tube member 132, while rotating with the feed screw shaft 102.

Even if the air is evacuated from the chamber 68 of the bellows 20 by the energizing action of the vacuum pressure supply source 72 to reduce the pressure in the chamber 68, therefore, the air is prevented by the seal 130 from leaking from the gap between the attachment plate 116 and the feed screw shaft 102. The other function and effect are the same as those of the first embodiment. Detailed explanation thereof is omitted.

Figure 8:
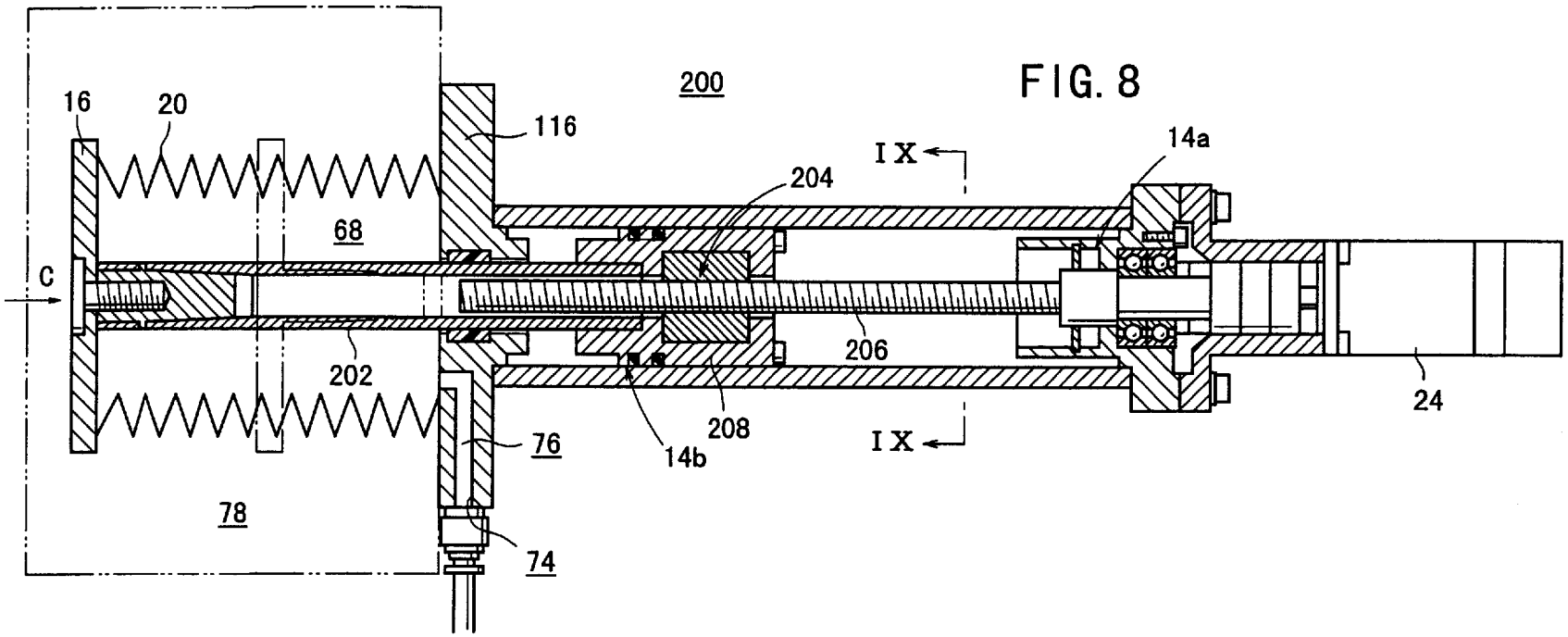
FIG. 8 is an axially longitudinal sectional view illustrating an actuator according to a third embodiment of the present invention.
Figure 9:
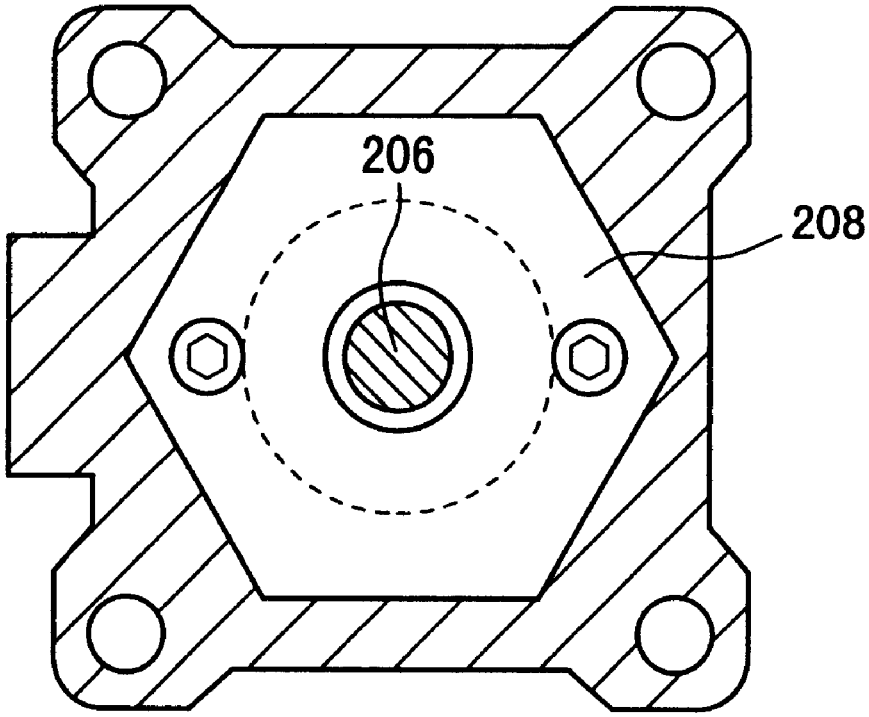
FIG. 9 is a vertical sectional view taken along a line IX—IX shown in FIG. 8.
Figure 10:
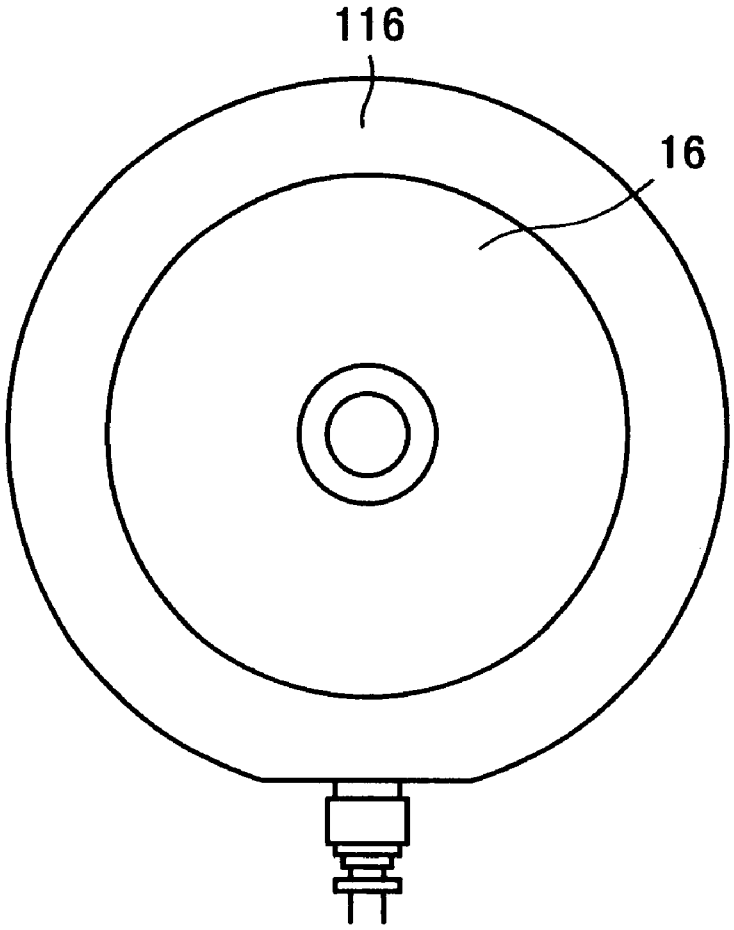
FIG. 10 is a side view as viewed in the direction of the arrow C shown in FIG. 8.

An actuator 200 according to a third embodiment of the present invention is shown in FIGS. 8 to 10.

The third embodiment is different from the first embodiment in that a rotary driving source 24, a first driving section 14*a,* and a second driving section 14*b* are arranged substantially coaxially. That is, a piston rod 202 of a cylinder serving as the second driving section 14*b* is hollow. A feed screw mechanism 204 is incorporated into the hollow space. Accordingly, the height size can be prevented from increasing and a small size can be realized.

In the actuators 10, 100 according to the first and second embodiments, the rotation-preventive effect is obtained because the feed screw shaft 48, 102 and the piston rod 60 are parallel to one another. In the actuator 200 according to the third embodiment in which the feed screw shaft 206 and the piston rod 202 are arranged coaxially, however, the rotation-preventive function is effected by forming a polygonal cross section (substantially hexagonal cross section in FIG. 9) for the contour of the piston 208.

The same rotation-preventive effect is also obtained by an unillustrated piston having a non-circular cross section including an elliptic cross section. Further, the cross section of the piston rod 202 may be of a polygonal or spline shape without changing the cross sectional shape of the piston 208.

The other function and effect are the same as those of the first embodiment. Detailed explanation thereof is omitted.

Figure 11:
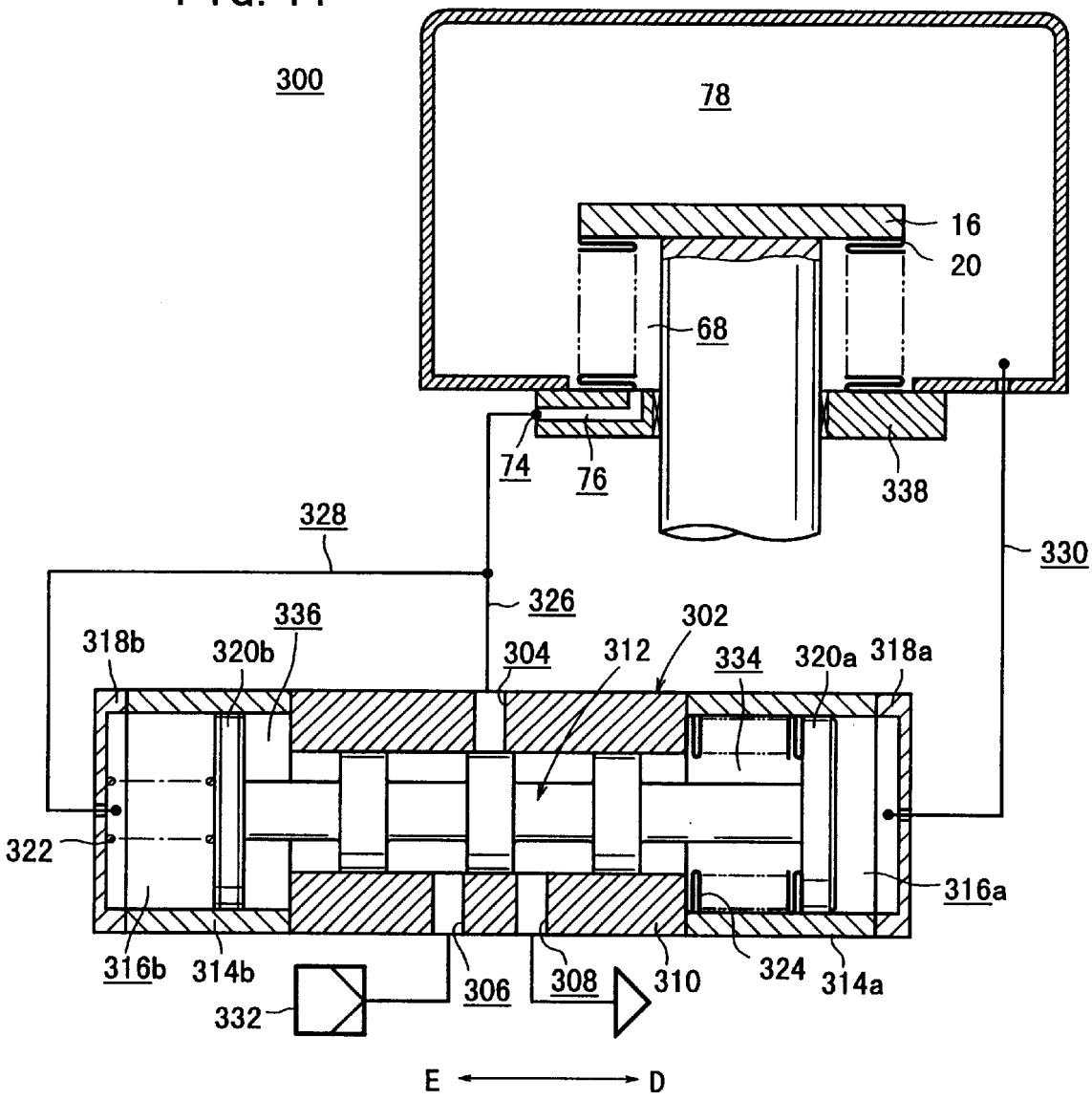
FIG. 11 is, with partial omission, a longitudinal sectional view illustrating an actuator according to a fourth embodiment of the present invention.
Figure 12:
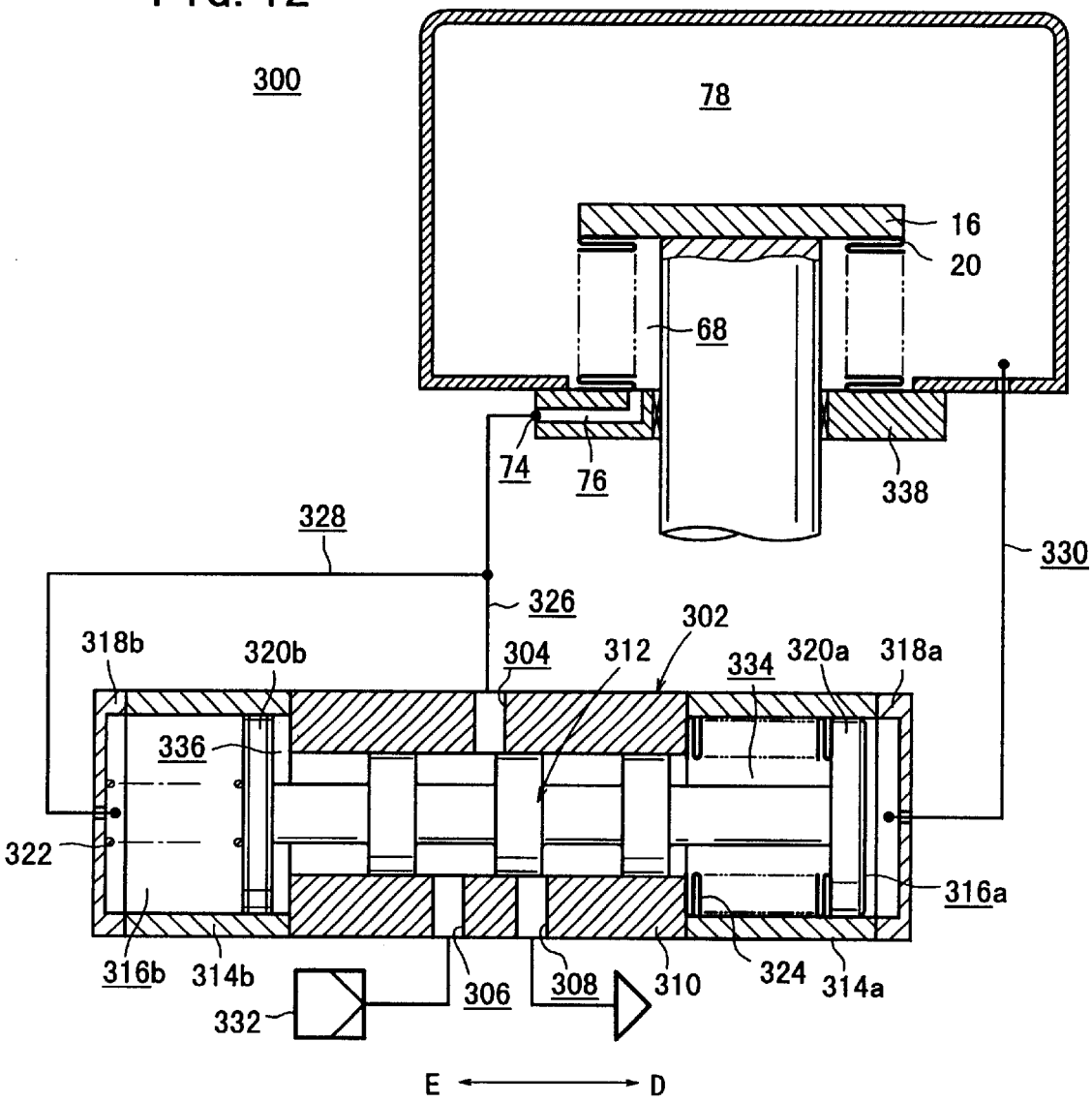
FIG. 12 is a longitudinal sectional view illustrating the operation of a vacuum pressure-balancing apparatus equipped for the actuator shown in FIG. 11.
Figure 13:
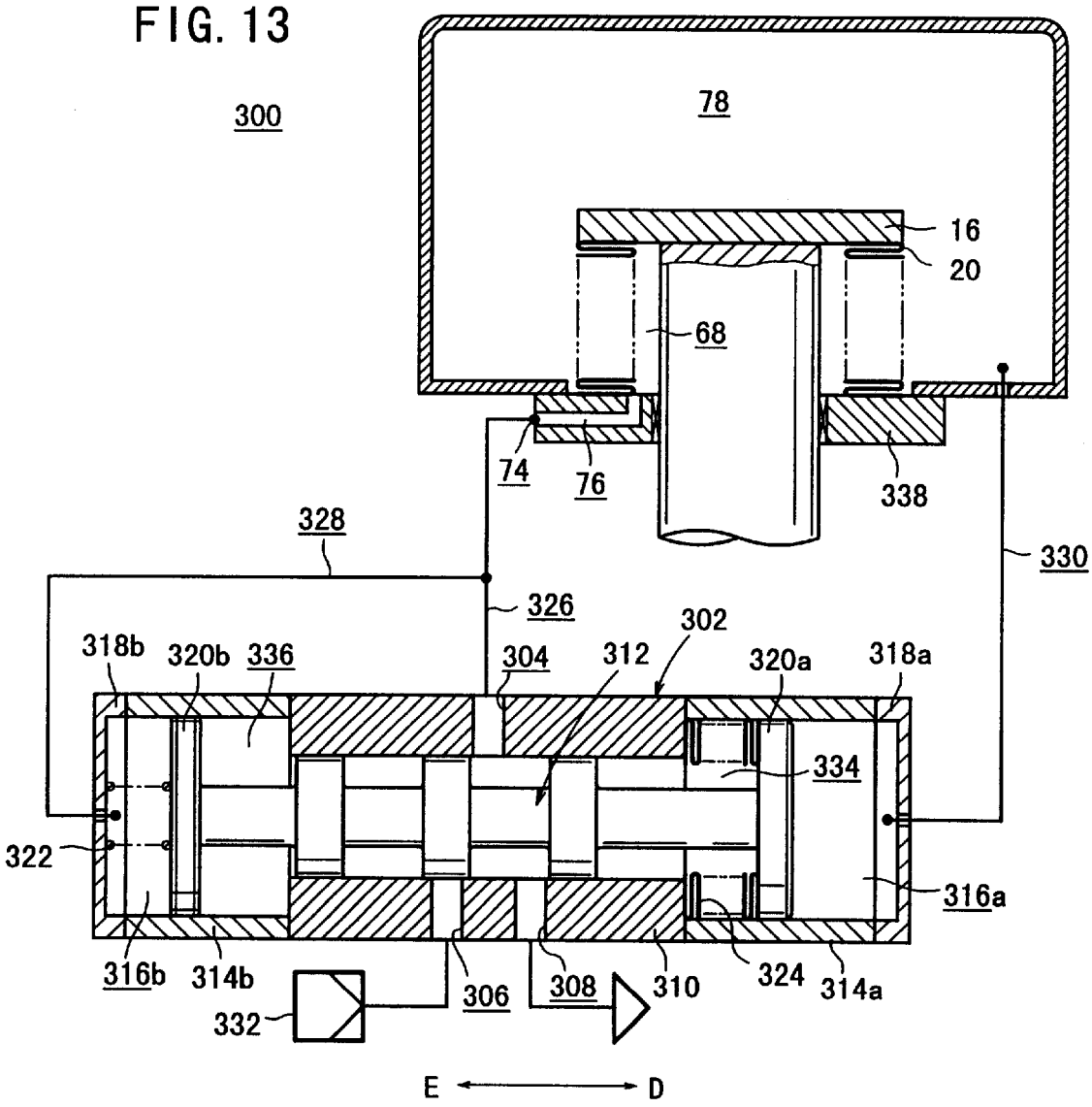
FIG. 13 is a longitudinal sectional view illustrating the operation of the vacuum pressure-balancing apparatus equipped for the actuator shown in FIG. 11.

An actuator 300 according to a fourth embodiment of the present invention is shown in FIGS. 11 to 13.

The actuator 300 according to the fourth embodiment is different from the actuators 10, 100, 200 according to the first to third embodiments in that the actuator 300 is equipped with a vacuum pressure-balancing apparatus 302 which reduces the vacuum pressure in the chamber 68 of the bellows 20 corresponding to the vacuum pressure in the vacuum chamber 78 to balance the vacuum pressure in the vacuum chamber 78 and the vacuum pressure in the chamber 68 of the bellows 20.

The vacuum pressure-balancing apparatus 302 comprises a housing 310, a spool valve 312 and first and second cover members 318*a,* 318*b*. The housing 310 has an output port 304, a vacuum-introducing port 306, and an atmospheric air-communicating port 308 respectively. The spool valve 312 is slidable substantially horizontally along the space in the housing 310. The first and second cover members 318*a,* 318*b* form a closed first pressure chamber 316*a* disposed on one side and a closed second pressure chamber 316*b* disposed on the other side respectively by first and second retainers 314*a,* 314*b* connected to ends of the housing 310.

A first piston 320*a* is connected to one end of the spool valve 312 and faces the first pressure chamber 316*a*. A second piston 320*b* is connected to the other end of the spool valve 312 and faces the second pressure chamber 316*b*. A spring 322 is interposed between the second cover member 318*b* and the second piston 320*b*. A bellows 324 made of metal is interposed between the housing 310 and the first piston 320*a*. The spring 322 is fastened to the end surface of the second piston 320*b* and the inner wall surface of the second cover member 318*b* by unillustrated fastening means.

The vacuum port 74 of the actuator 300 is communicated and connected through a first passage 326 with the output port 304 of the vacuum pressure-balancing apparatus 302. The vacuum port 74 is communicated and connected with the second pressure chamber 316*b* of the vacuum pressure-balancing apparatus 302 through a second passage 328 which is branched from an intermediate position of the first passage 326. The vacuum chamber 78 to which an attachment plate 338 is installed is communicated and connected with the first pressure chamber 316*a* of the vacuum pressure-balancing apparatus 302 through a third passage 330. Further, a vacuum pump 332 is connected to the vacuum-introducing port 306 of the vacuum pressure-balancing apparatus 302.

The effective diameter of the bellows 324 interposed between the housing 310 and the first piston 320*a* needs to be coincident with the diameter of the first piston 320*a*. The spring constant of the bellows 324 is coincident with that of the spring 322. Each of the space 334 surrounded by the bellows 324 and the space 336 surrounded by the second retainer 314*b* and the second piston 320*b* communicates with the atmospheric air with an unillustrated variable throttle.

The operation, function, and effect of the vacuum pressure-balancing apparatus 302 will be explained below. It is assumed that the state of the spool valve 312 shown in FIG. 11 resides in the intermediate position. At the intermediate position, the output port 304 does not communicate with the vacuum-introducing port 306 and the atmospheric air-communicating port 308.

When the vacuum pressure in the vacuum chamber 78 is reduced to a predetermined vacuum pressure by the negative pressure of the unillustrated vacuum pump, the first pressure chamber 316*a* of the vacuum pressure-balancing apparatus 302, which communicates through the third passage 330, is also subjected to the reduction of pressure. When the pressure of the first pressure chamber 316*a* is reduced, therefore, the first piston 320*a* and the spool valve 312 are integrally displaced from the intermediate position in the direction of the arrow D. The bellows 324 is consequently elongated. When the spool valve 312 is displaced in the direction of the arrow D, the output port 304 communicates with the vacuum-introducing port 306 as shown in FIG. 12. Therefore, the negative pressure fluid is supplied from the vacuum pump 332 and passes through the vacuum-introducing port 306, the output port 304, the first passage 326, and the vacuum port 74 of the attachment plate 338. The negative pressure fluid is supplied into the chamber 68 of the bellows 20. The pressure in the chamber 68 of the bellows 20 is reduced.

In FIG. 12, the second pressure chamber 316*b* communicates with the interior of the chamber 68 of the bellows 20 through the second passage 328. When the pressure in the chamber 68 of the bellows 20 is reduced and the first and second pressure chambers 316*a,* 316*b,* which are arranged at the right and the left, have a substantially identical pressure, then the force of pulling the spool valve 312 toward the intermediate position is exerted by the compressive force (spring force) of the bellows 324 made of metal elongated by the displacement of the spool valve 312. The spool valve 312 returns to the intermediate position by the pulling force of the bellows 324. At the intermediate position, the communication between the output port 304 and the vacuum-introducing port 306 is blocked and the negative pressure fluid ceases to be supplied into the chamber 68 of the bellows 20.

Even if the vacuum pressure in the vacuum chamber 78 is intensified, therefore, it is possible to balance the vacuum pressure in the chamber 68 of the bellows 20 corresponding to the vacuum pressure in the vacuum chamber 78.

By contrast, when the atmospheric air is introduced into the vacuum chamber 78, the first pressure chamber 316*a* is pressurized to displace the spool valve 312 in the direction of the arrow E. When the spool valve 312 is displaced in the direction of the arrow E, the output port 304 communicates with the atmospheric air-communicating port 308 as shown in FIG. 13 and the atmospheric air is introduced into the chamber 68 of the bellows 20 through the first passage 326. The atmospheric air is also introduced into the second pressure chamber 316*b* through the second passage 328 branched from the first passage 326. The first and second pressure chambers 316*a,* 316*b,* which are arranged at the right and the left, are kept under substantially identical pressure. Therefore, the force of pressing the spool valve 312 toward the intermediate position is exerted by the resiliency (spring force) of the spring 322 compressed by the displacement of the spool valve 312. The spool valve 312 returns to the intermediate position by the resiliency of the spring 322. At the intermediate position, the communication between the output port 304 and the atmospheric air-communicating port 308 is blocked. The atmospheric air ceases to be supplied into the chamber 68 of the bellows 20.

Even if the atmospheric air is introduced into the vacuum chamber 78 and the vacuum pressure is weakened, therefore, it is possible to balance the vacuum pressure in the chamber 68 of the bellows 20 corresponding to the vacuum pressure in the vacuum chamber 78.

Thus, it is possible to balance the vacuum pressure between the vacuum chamber 78 and the chamber 68 of the bellows 20 by easily regulating the vacuum pressure in the chamber 68 of the bellows 20 corresponding to the vacuum pressure in the vacuum chamber 78 as described above.

The other function and effect of the actuator 300 according to the fourth embodiment are the same as those of the first embodiment. Detailed explanation thereof is omitted.

While the invention has been particularly shown and described with reference to preferred embodiments, it will be understood that variations and modifications can be effected thereto by those skilled in the art without departing from the spirit and scope of the invention as defined by the appended claims.

What is claimed is:

1. An actuator having a slider displaceable under a driving action of a driving section, said actuator comprising:

an attachment plate for installing a main actuator body so that said slider can be accommodated in a vacuum chamber;

a driving rod for displacing said slider under said driving action of said driving section; and a bellows surrounding said driving rod and being installed between said slider and said attachment plate to form a closed chamber, an air in said chamber of said bellows being evacuated by a vacuum pressure supply source connected to a vacuum port of said attachment plate.

2. The actuator according to claim 1, wherein said driving section includes a first driving section serving as a main driving source and a second driving section serving as an auxiliary driving source, said first driving section having a rotary driving force-transmitting mechanism for converting rotary driving force of a rotary driving source into rectilinear motion to be transmitted to said slider, and said second driving section having a piston and a piston rod which are displaceable together by pressure fluid supplied to a cylinder chamber.

3. The actuator according to claim 2, wherein said driving rod comprises a feed screw shaft disposed in said first driving section and having one end protruding from said attachment plate and connected to said slider, and said piston rod disposed in said second driving section and having one end protruding from said attachment plate and connected to said slider, said feed screw shaft and said piston rod being surrounded by said bellows.

4. The actuator according to claim 1, wherein said driving rod comprises a feed screw shaft having one end protruding from said attachment plate and connected to said slider and a gap is sealed between said attachment plate and said feed screw shaft by a seal member, said seal member having a threaded portion screwed over said feed screw shaft and being rotatable by reciprocating movement of said feed screw shaft.

5. The actuator according to claim 2, wherein said feed screw shaft disposed in said first driving section and said piston rod disposed in said second driving section are substantially parallel to one another.

6. The actuator according to claim 2, wherein said feed screw shaft disposed in said first driving section and said piston rod disposed in said second driving section are substantially coaxial.

7. The actuator according to claim 1, wherein said actuator is equipped with a vacuum pressure-balancing apparatus for balancing a vacuum pressure in said chamber of said bellows corresponding to a vacuum pressure in said vacuum chamber.

8. The actuator according to claim 7, wherein said vacuum pressure-balancing apparatus has a spool valve disposed between a first chamber communicating with said vacuum chamber and a second chamber communicating with said chamber of said bellows, said spool valve being displaced based upon a pressure difference between said first chamber and said second chamber for selectively supplying vacuum pressure or atmospheric pressure into said chamber of said bellows.

9. The actuator according to claim 1, wherein said bellows is formed of a metal material.

* * * * *